US005647178A

United States Patent [19]

Cline

[11] Patent Number: 5,647,178

[45] Date of Patent: Jul. 15, 1997

[54] THROUGH-ROOF FITTINGS

[75] Inventor: Roger M. Cline, P.O. Box 370, Purceville, Va. 22132

[73] Assignee: Roger M. Cline, Bluemont, Va.

[21] Appl. No.: 535,381

[22] Filed: Sep. 28, 1995

[51] Int. Cl.[6] ..... E04D 13/14

[52] U.S. Cl. ..... 52/219; 285/43

[58] Field of Search ..... 285/42, 43, 44, 285/205; 52/198, 199, 200, 218, 219

[56] References Cited

U.S. PATENT DOCUMENTS

| | | | |
|---|---|---|---|
| 1,174,763 | 3/1916 | Redlon | 285/44 |
| 1,931,066 | 10/1933 | Eckert . | |
| 3,520,245 | 7/1970 | Painter . | |
| 4,223,486 | 9/1980 | Kelly . | |
| 4,524,262 | 6/1985 | Meyer | 52/219 X |
| 4,593,504 | 6/1986 | Bonnici et al. . | |
| 4,757,654 | 7/1988 | Korhonen et al. . | |
| 5,237,789 | 8/1993 | Thaler | 285/42 X |
| 5,472,241 | 12/1995 | Kosik | 285/43 X |

*Primary Examiner*—Dave W. Arola
*Attorney, Agent, or Firm*—James Creighton Wray

[57] ABSTRACT

A through-roof fitting seals a stack with a boot and seals the boot with a gasket around an opening in a sheet roofing created to receive the stack or pipe. An elliptical opening is cut in the roofing sheet. A base plate is placed below the sheet with a central raised portion of the plate extending through the opening cut in the roofing sheet. A flange on the base plate extends outwardly beneath the roofing sheet around the opening. A clamping plate is embedded in a combined boot and gasket so that the gasket extends over the roofing sheet around the opening when an elliptical step in the clamping plate is aligned with the projecting central portion of the base plate. The boot has successively inwardly stepped elliptical portions which terminate in a sloped top with a central opening for receiving and tightly engaging and sealing the pipe or stack. The embedded clamping plate has fastener openings which align with fastener receivers in the base plate. Bosses surrounding the openings extend through the boot to abut heads of elongated fastener bolts which thread into nuts which are pressfit into the fastener receivers in the flange plate. Tightening the fasteners compresses the gasket, sealing the opening in the roofing sheet.

17 Claims, 8 Drawing Sheets

THROUGH-ROOF FITTINGS

BACKGROUND OF THE INVENTION

This invention concerns through-roof fittings for seamed metal roofs which are anchored to underlying roof board or sheathing and rafters for sliding along the roof surface as the roofing materials expand and contract.

Sheet material roofs such as metal roofs with standing seams have gained popularity and have become widely used in expensive homes and buildings.

The success of standing seam sheet metal roofs in protecting buildings can be seen in old farmhouses, for example, in which the structures are still intact because of the successful rain barriers formed by the standing seam metal roofs.

One of the attributes of a sheet metal roof is that it is capable of moving on the underlying roof sheathing as the metal contracts or expands with severe temperature changes. The expansion and contraction of the roof when unfettered encourages the long life of the roof because buckling and lifting is avoided.

When fixed pipes protrude from roofs, such as stacks which vent sewer lines, the roofing sheets must be sealed to the fixed stack. That sometimes causes the roofing sheets to be anchored in an undesired location on the roof which promotes buckling or tearing upon expansion or contraction. Such vents are often sealed to a roofing sheet by a bituminous substance such as roofing tar or by rubber grommets, which additionally may be tarred. The stacks may be sealed to the roof by slitting an overlying tin sheet, placing the slit over the stack and nailing the tin sheet to the roof sheathing or rafters below, and then sealing that sheet to the stack. That causes unsightly buckling and unintended movement of the roofing sheets upon the roof. Moreover, the penetration of the roof sheathing by nails causes additional breaks in the security of the roof, allowing different channels for the entry of water to damage the underlying sheathing and roof.

Needs have long existed for through-roof fittings which seal sheet roofs, such as standing seam metal roofs, without destroying the roof or the appearance of the roof or the watertight sealing of the roof.

SUMMARY OF THE INVENTION

This invention provides new through-roof fitting seals for sealing around stacks and pipes of roofs, particularly of sheet material roofs and of standing seam metal roofs. The fittings have generally elliptical or oval shapes, as racetracks with semicircular ends joined by straight midsections.

The new through-roof fitting seals a stack with a boot and seals the boot with a gasket around an opening in a sheet roof created to receive the stack or pipe. An elliptical opening is cut in the roofing sheet. A base flange plate is placed below the sheet, with a central raised portion of the plate extending through the opening cut in the roofing sheet. A flange on the flange plate extends outwardly beneath the roofing sheet around the opening. An elliptical clamping plate is embedded in a combined elliptical boot and gasket. The gasket extends over the roofing sheet around the opening when the gasket or an elliptical step in the clamping plate is aligned with the projecting central portion of the flange plate. The boot has successively inwardly stepped elliptical portions which terminate in a sloped top with a central opening for receiving and tightly engaging and sealing the pipe or stack. The embedded clamping plate has fastener openings which align with fastener receivers in the flange plate. Bosses surrounding the openings extend through the boot to abut heads of elongated fastener bolts which thread into nuts which are pressfit into the fastener receivers in the flange plate. Tightening the fasteners compresses the gasket, sealing the opening in the roofing sheet.

A preferred through-roof fitting surrounds and seals a pipe or stack where it extends through a roofing sheet. A flange plate has a generally oval laterally extended flange base and a generally oval body extending upward from the flange base for extending the body through a complementary general oval opening in a roof. The flange is positioned under the roof around the opening. First fasteners are secured in the body and are accessible generally perpendicular to the flange.

A clamp has a generally oval second flange for cooperating with the flange plate flange and has a generally oval clamp body for overlying the flange plate body. Openings in the clamp body align with openings and fasteners in the flange plate body for receiving fasteners.

A molded boot has a boot base for overlying and surrounding the clamp body. The boot base has openings aligned with the openings in the clamp body for receiving fasteners.

An integrally formed generally oval sleeve is connected to an inward edge of the boot base. The sleeve has a relatively long sloping wall at one end of the oval boot base, and a relatively short sloping wall at the other end of the oval boot base. A sloping circular boss is connected to a top of the boot sleeve near the sloping walls. A large circular opening in the boss receives and seals a pipe or stack.

A plurality of second complementary fasteners are connected to the first fasteners. A sealing gasket is interposed between the clamp insert flange and the roofing sheet for compressing against the roofing sheet when the first fasteners and second fasteners are joined and tightened for sealing and preventing leakage around the roofing sheet opening and the flange plate body.

The preferred gasket is integrally formed with the molded boot. The clamp is integrally molded as a core within the boot.

The preferred first fasteners are nuts captured in openings of the flange plate body. The second fasteners are bolts extending through the openings in the clamp body.

The clamp body includes bosses surrounding the openings and extending upward through the boot body. The bolts have heads which bear against the bosses. The nuts are pressed into interference fit in the openings within the flange plate body.

In one embodiment, the openings extend completely through the flange plate body. The openings are hexagonal and are tapered from relatively wide openings at the base to relatively narrow openings at a top of the flange plate body. The nuts are pressed into the openings from the bottom of the flange plate body.

A preferred method for sealing a through-roof fitting in a metal roof includes cutting an elliptical opening in the metal roofing. The method inserts a flange plate under the metal roofing and turns and projects a central portion of the flange plate through the roofing opening while positioning a flange of the flange plate under the roof around the opening in the roofing sheet.

First fasteners are fixed in the central portion of the flange plate. A gasket is placed around the central portion of the flange plate and over the roof around the opening. A clamp plate is placed over the central portion of the flange plate and over the gasket. By aligning a central portion of the clamp plate with the protruding central portion of the flange plate, a flange on the clamp plate is aligned over the gasket. A pipe or stack is passed through a central opening in a flexible boot and seals the central opening around the pipe or stack. The boot is connected to the gasket. Second complementary fasteners are inserted through openings in the central portion of the clamp plate, and the first and second complementary fasteners are connected. The first and second complementary fasteners are tightened, thereby compressing the gasket against the roofing around the opening and sealing the roofing sheet opening with the gasket.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
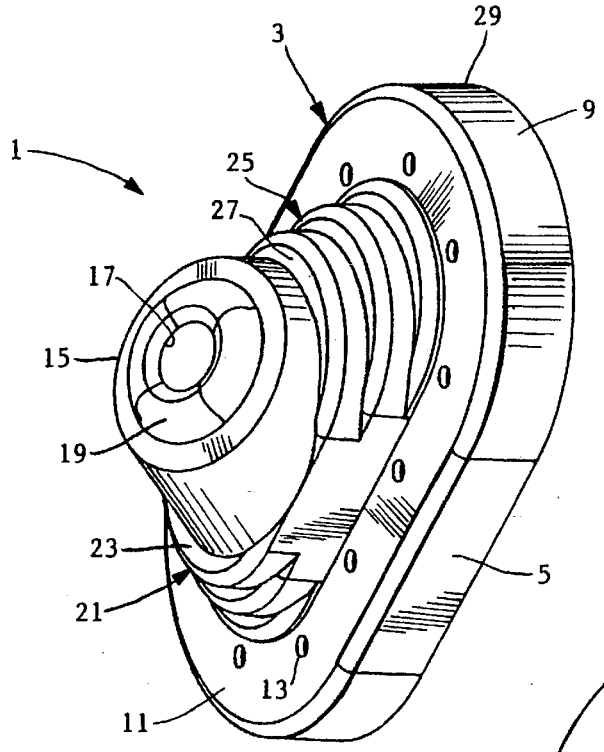
FIG. 1 is a perspective view of a through-roof fitting as it appears from outside the roof before the bolts are inserted.

Referring to FIG. 1, a through-roof fitting is generally indicated by the numeral 1. The part of the through-roof fitting which is visible above the roof is a boot generally indicated by the numeral 3. The boot has a generally oval body 5 with a continuous side wall 9. A top surface 11 has openings 13 which receive fasteners for connecting the boot and the embedded clamp plate insert to a base flange plate. The boot has a crown portion 15 with a circular opening 17 for tightly engaging a stack or pipe which extends through the underlying roof. Thick walls 19 provide the elasticity which seals the opening 17 of the boot tightly around the pipe or stack. A long lower sloping wall 21 has a series of steps 23 for providing flexibility to the boot. A shorter upper sloping wall 25 has a similar series of steps 27.

The side wall of the boot has an integrally formed gasket beneath the boot which is squeezed between the embedded clamp plate and the roofing sheet as supported by an inner part of the underlying base flange plate. The gasket seals and prevents water from seeping into the roof around edge 29.

Figure 2:
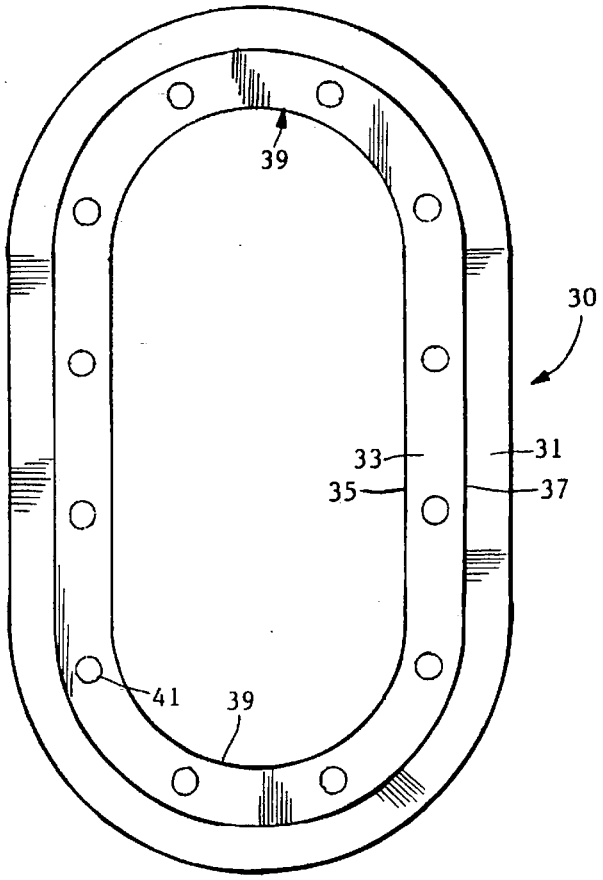
FIG. 2 is a plan view of a base flange plate with the outer flange positioned beneath a roofing sheet and the inner portion projecting through a hole in the roofing sheet.

FIG. 2 is a plan view of one embodiment of a base flange plate generally indicated by the numeral 30. The base flange plate has an outer flange portion 31 and an inner portion 33, which projects upwardly through an opening in a roofing sheet material. The inner portion 33 has an inner side wall 35 and an outer side wall 37, which is generally the size and shape of an opening cut in the roofing sheet material. The upper and lower ends 39 are radiused. Fastener receiving holes 41 are located in the inner portion 33 of the base flange plate 30. The ribs and recesses strengthen and flatten the base and flange.

Figure 3:
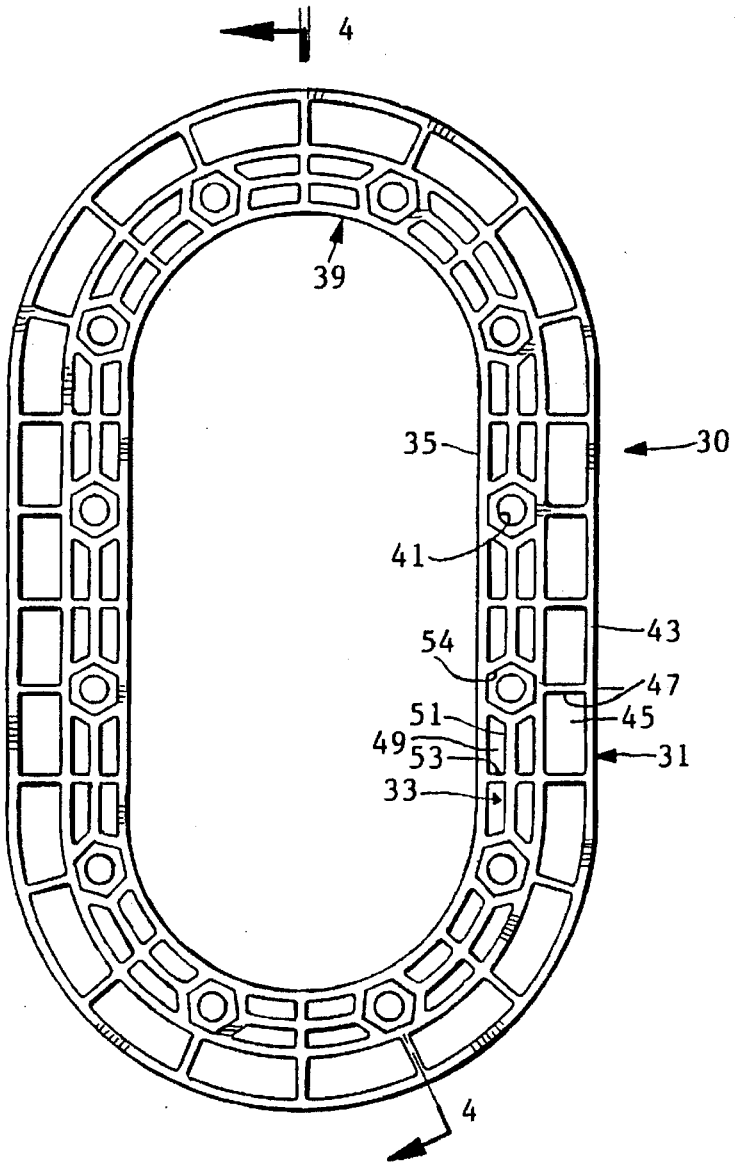
FIG. 3 is a bottom view of the base flange plate shown in FIG. 2.

FIG. 3 is a bottom view of the base flange plate 30 shown in FIG. 2. The bottom surface 43, which rests on the underlying roof boards or roof sheathing. A series of recesses 45 and ribs 47 form the flange portion 31. Deep recesses 49 and longitudinal and cross ribs 51 and 53 form the central portion 33.

Hexagonal recesses 54, which are slightly tapered upward, receive and hold hexagonal nuts as first fasteners. The nuts are pressed into the recesses and are held therein by a tight frictional pressfit. In a preferred form of the invention, the hexagonal recesses 54, which are tapered from relatively large openings at the bottom to relatively small openings at the top, extend all of the way through the central portion 33.

Figure 4:
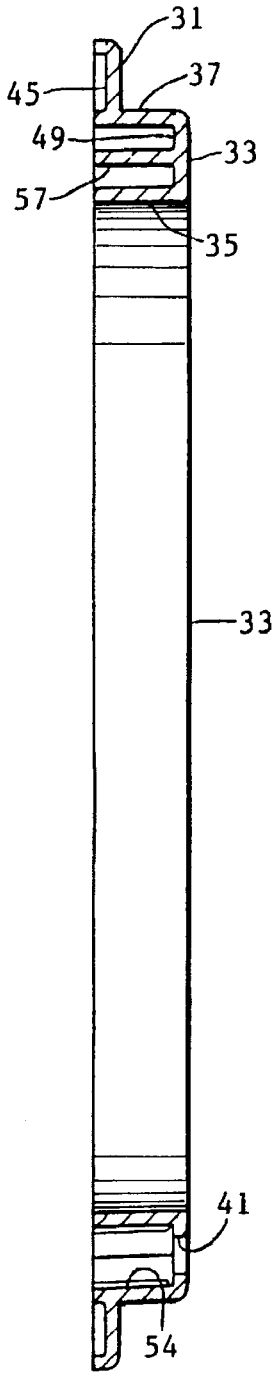
FIG. 4 is a sectional view of the base flange plate taken along line 4—4 of FIG. 3.

A preferred material for molding the flange plate is a 40% glass-filled polycarbonate, which is molded to the wall thickness of approximately 1/10th of an inch, with draft angles of about ½°. The shape of the base flange plate and the relative thicknesses of the flange and central portions 31 and 33 are best shown in FIG. 4.

Figure 5:
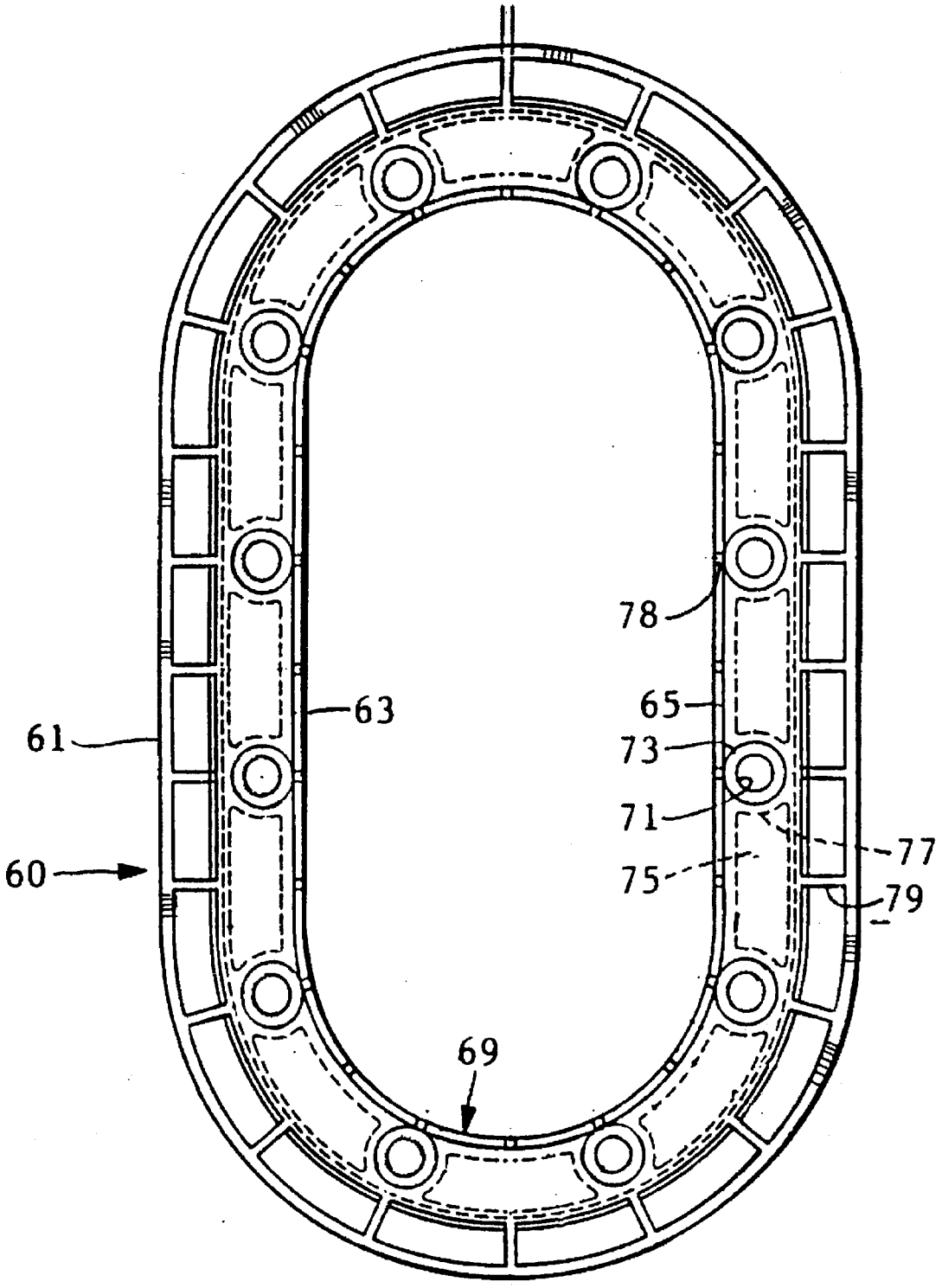
FIG. 5 is a plan view of a clamp plate insert.
Figure 6:
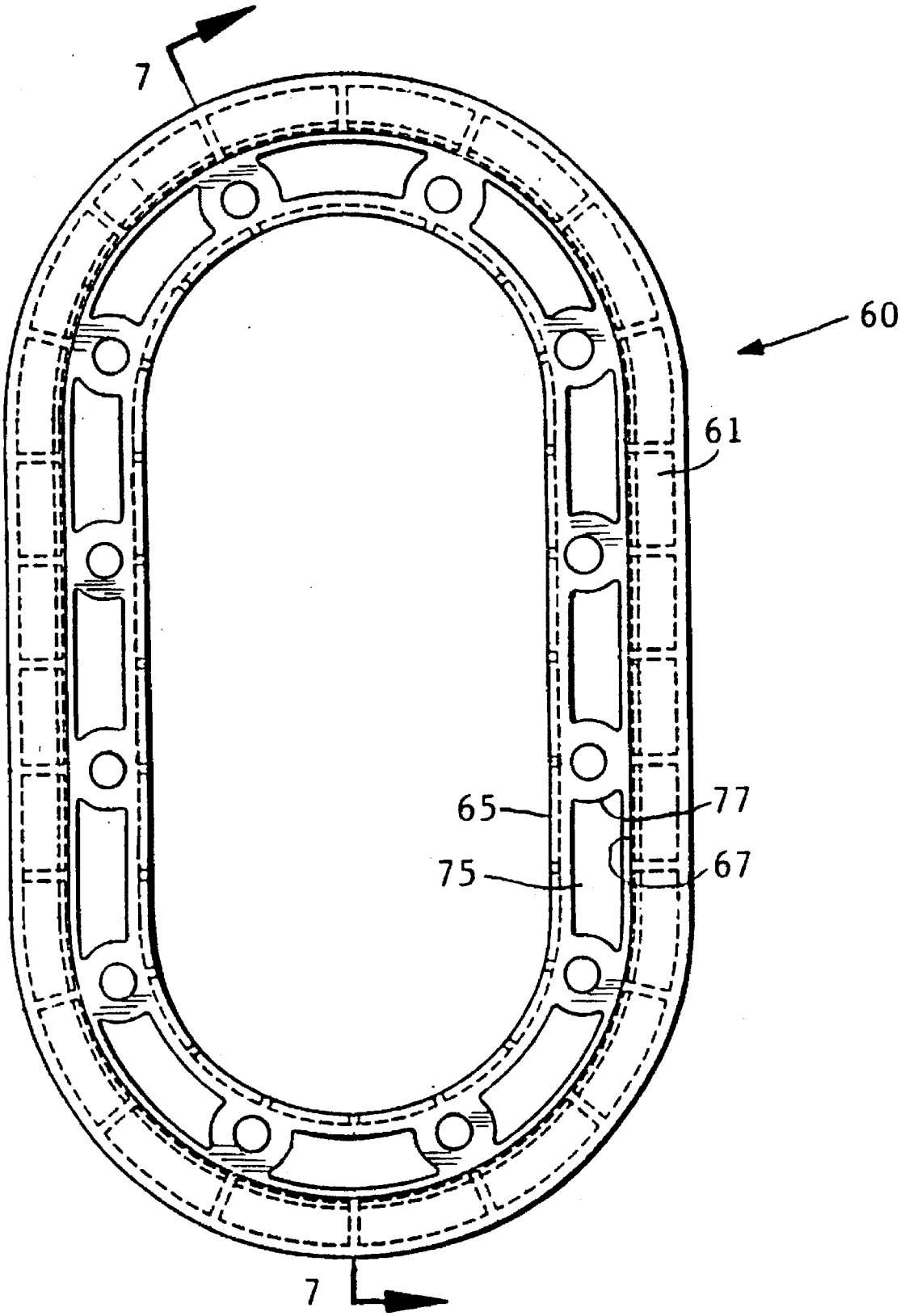
FIG. 6 is a bottom view of the clamp plate insert.
Figure 7:
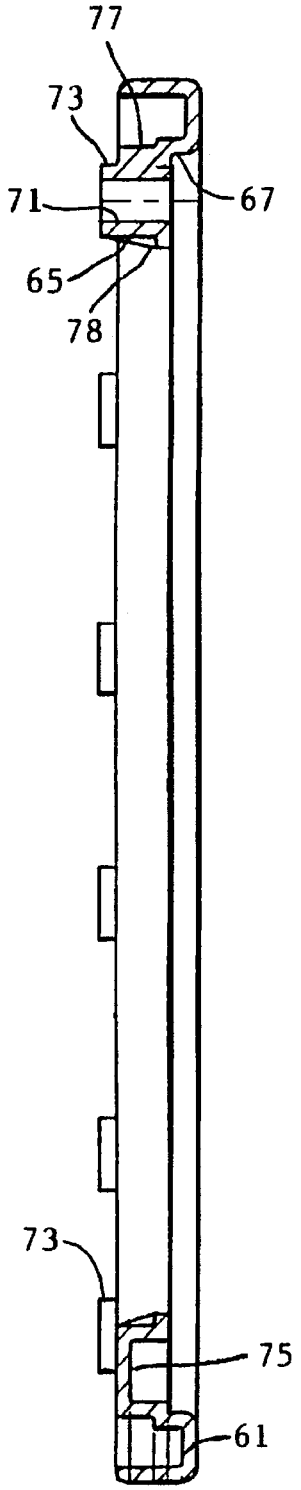
FIG. 7 is a side cross-sectional view of the clamp plate insert taken along line 7—7 of FIG. 6.

FIGS. 5, 6 and 7 show a clamping plate which is preferably inserted in the boot. FIG. 5 is a plan view of the clamping plate 60. The clamping plate has an outer flange area 61 and an inner section 63.

The bottom face of flange area 61 is flat, as shown in FIG. 7. The internal wall 65 of the internal section 63 generally aligns with wall 35 in the inner section of the base flange plate. Wall 67 may receive the upper portion of wall 37 of the base flange plate to achieve alignment. The upper and lower sections 69 of the insert clamp plate are radiused to provide a racetrack, oval or generally elliptical shape. Openings 71 extend through the inner section 63 to receive second complementary fasteners, in this case threaded bolts. The openings have bosses 73, which extend above the top plane of the central section 63 for extending through a boot in which the clamp plate is embedded. The bolt heads engage the bosses 73 when tightened. The central section is formed of deep recesses 75 and large generally cylindrical ribs 77, through which the fastener receiving holes 71 are formed. The flange area is supported by ribs 79. Ribs 78 support the inner wall 65.

Figure 8:
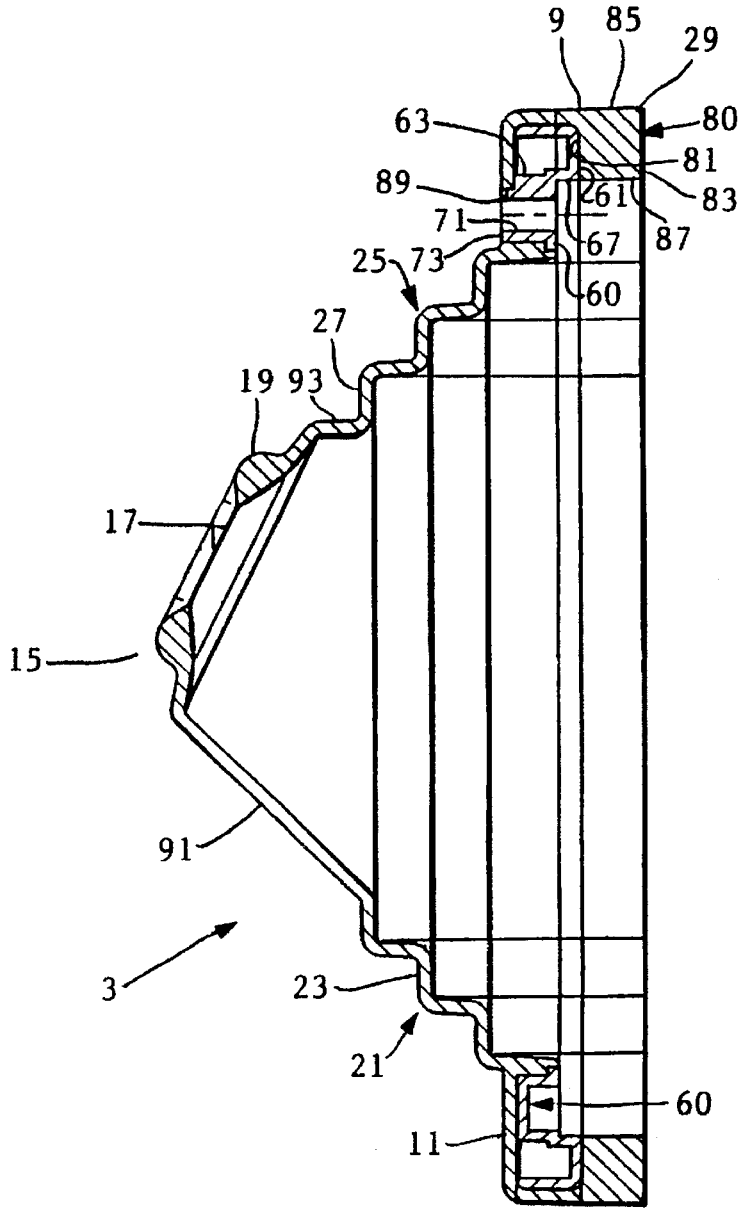
FIG. 8 is a side elevation of the molded boot with the clamp plate insert.
Figure 9:
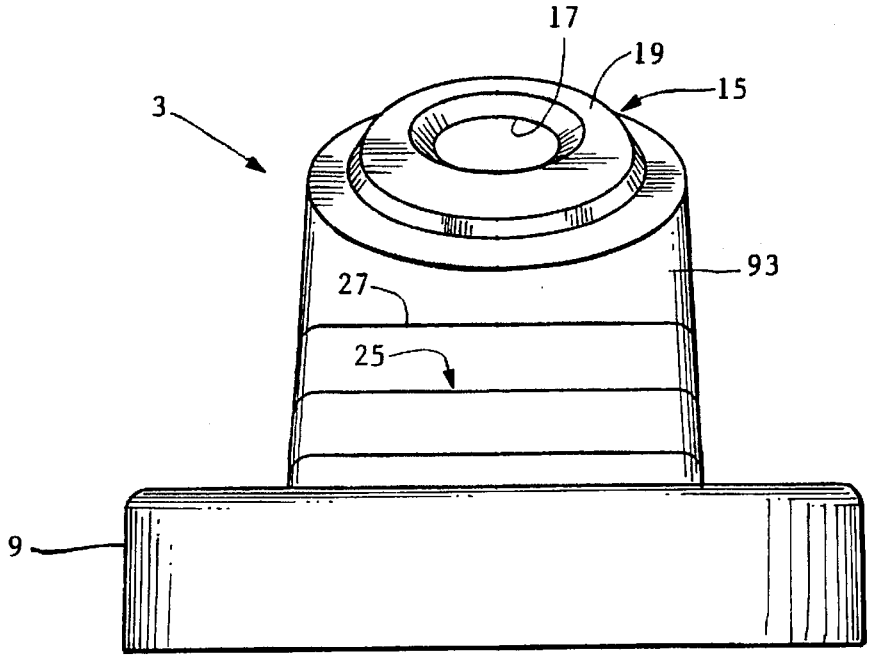
FIG. 9 is an end view of the molded boot.
Figure 10:
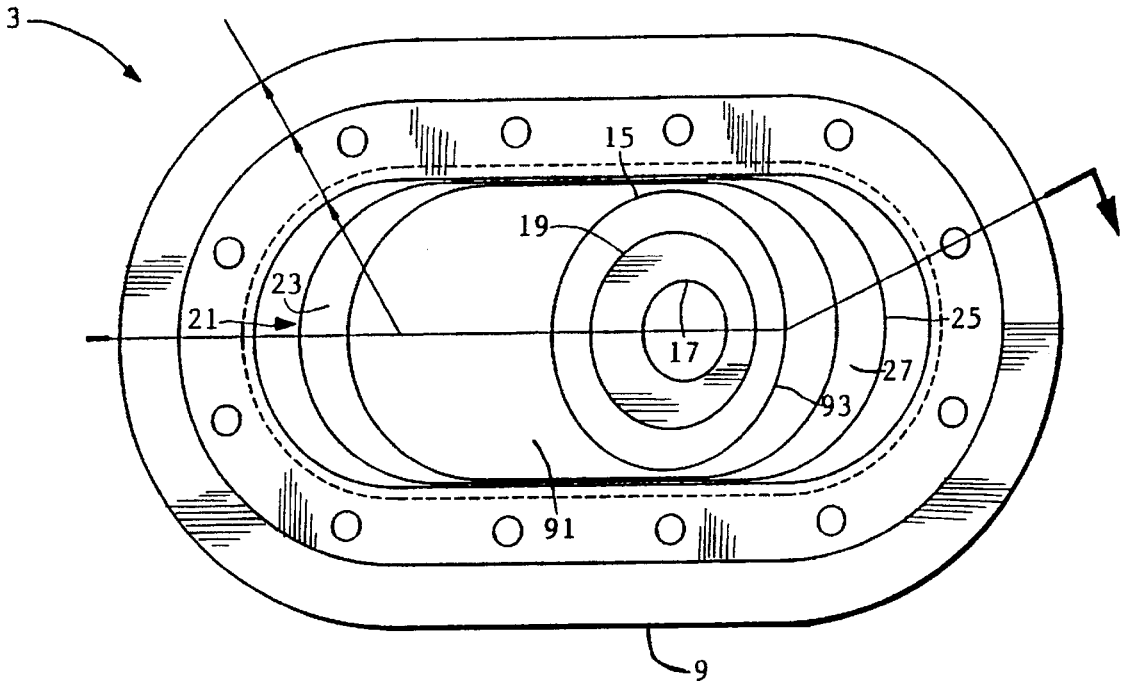
FIG. 10 is a plan view of the molded boot.

The boot 3 is shown in FIGS. 8, 9, 10 and 11. FIG. 8 shows the boot molded over the embedded clamp plate 60. The shape of the clamp plate 60 can be recognized from the same shape shown in FIG. 7.

As shown in FIG. 8, the boot has an integrally formed gasket 80 connected to the bottom of the boot at the side walls 9. The boot has an upper wall 81 which is molded against the flange 61 of the clamping plate 60. A lower wall 83 of the gasket 80 lies against the roofing sheet to seal the roofing sheet and to prevent ingress of water from edge 29. An outer wall 85 of the gasket is a continuation of the outer wall 9 of the boot. The inner wall 87 of the gasket is molded in continuation of the inner wall 67 of flange 61 of the clamping plate 60, so that the outer wall 37 of the base plate central section is closely received within the walls 87 and 67.

The flat area 11 of the boot fits over the flange area 61 and the inner section 63 of the clamping plate. The flat area has openings 89 which receive the bosses 73 around the openings 71 in the clamping plate.

The sloping longer upper wall 21 and the shorter upper wall 25 are stepped for flexibility to accommodate pipes and stacks at different roof pitches. An upper portion 91 of wall 21 is elongated with respect to an upper portion 93 of wall 25 to accommodate for a range of roof pitches and to provide additional flexibility.

Figure 11:
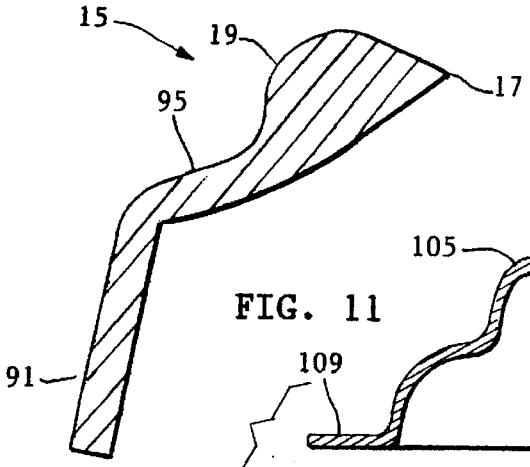
FIG. 11 is a detail of the edge of the boot opening which contacts the stack or pipe.
Figure 12:
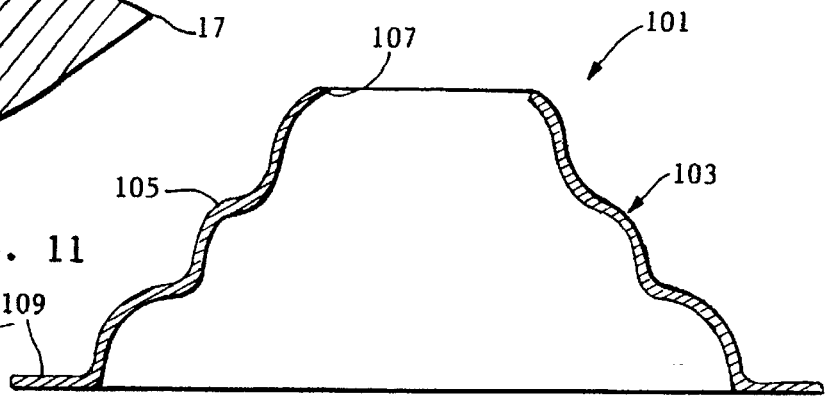
FIG. 12 is a cross-sectional exploded view of a second embodiment.
Figure 12:
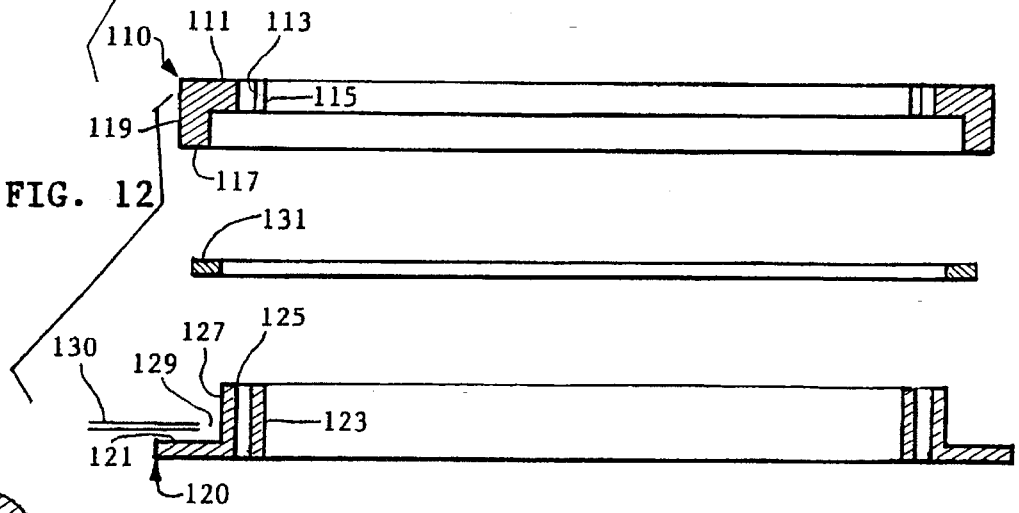

As shown in FIG. 11, which is a detail of the crown portion 15 shown in FIG. 1, a thin edge 17 is provided for tightly sealing against pipes and stacks. A bulbous portion 19 supports the inward force of the sealing edge 17, and wall 95 generally orients the crown portion perpendicularly to a pipe or stack.

The boot is molded of glass filled polycarbonate. Any elastomeric material is acceptable which will maintain its sealing force on the stack or pipe and maintain flexibility for accommodation of roof slopes and movement of the roofing during temperature extremes.

Another embodiment of the invention is shown in FIGS. 12–15. A through-roof seal is generally indicated by the numeral 101. The boot is generally indicated by the numeral 103. The boot has stepped walls 105 formed in a generally elliptical shape. A circular opening 107 at the top engages a pipe or stack. Flat sealing portions 109 are bonded to upper surfaces 111 of clamping plates 110. Holes 113 extend through the inward sections 115 of the clamping plates. Complementary holes extend through the flat portions 109 of the boot 103 for receiving fasteners, in this case threaded bolts. A clamping flange 117 is formed on an outer portion 119 of the clamping plate 110. A base flange plate 120 has a flange 121 surrounding a central portion 123, with threaded openings 125 to receive the bolts. An outer wall 127 of the central portion 123 fits within an opening 129 formed in a roofing sheet 130. A gasket 131 is placed over the roofing sheet 130 around the opening 129 after the elliptical flange plate is inserted in the opening. The flange 121 supports the roofing sheet adjacent the opening 129. The inner portion 123 extends through the opening. The clamping plate 110, to which the boot 103 has been bonded, is brought into contact with the gasket. The bolts are inserted and tightened to compress the gasket 131 against the roofing around the opening between the flat flanges 117 of the clamping plate and 121 of the base plate.

Figure 13:
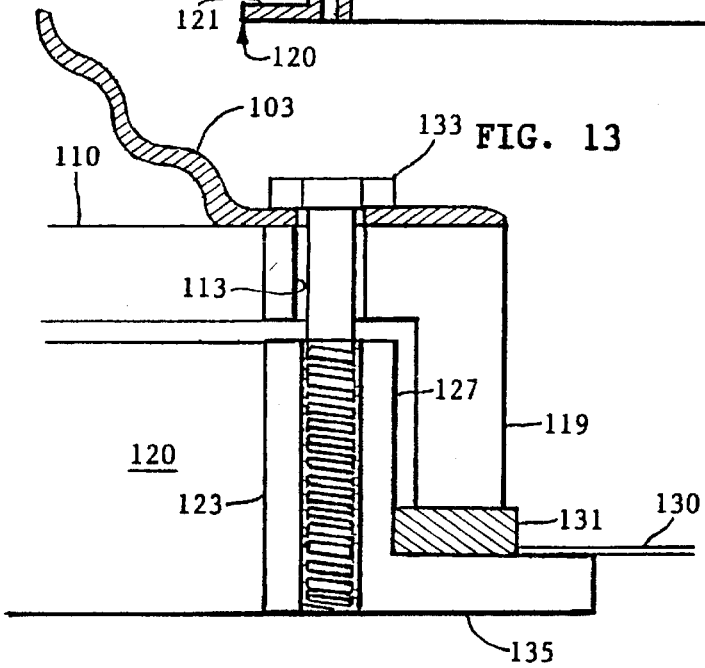
FIG. 13 is an assembled detail of the second embodiment.

FIG. 13 is a detail of the apparatus with the fastener 133 installed, which clamps the gasket 131 on the roofing sheet 130. The flat base 135 of the flange plate 120 rests upon the underlying roof board or sheathing.

Figure 14:
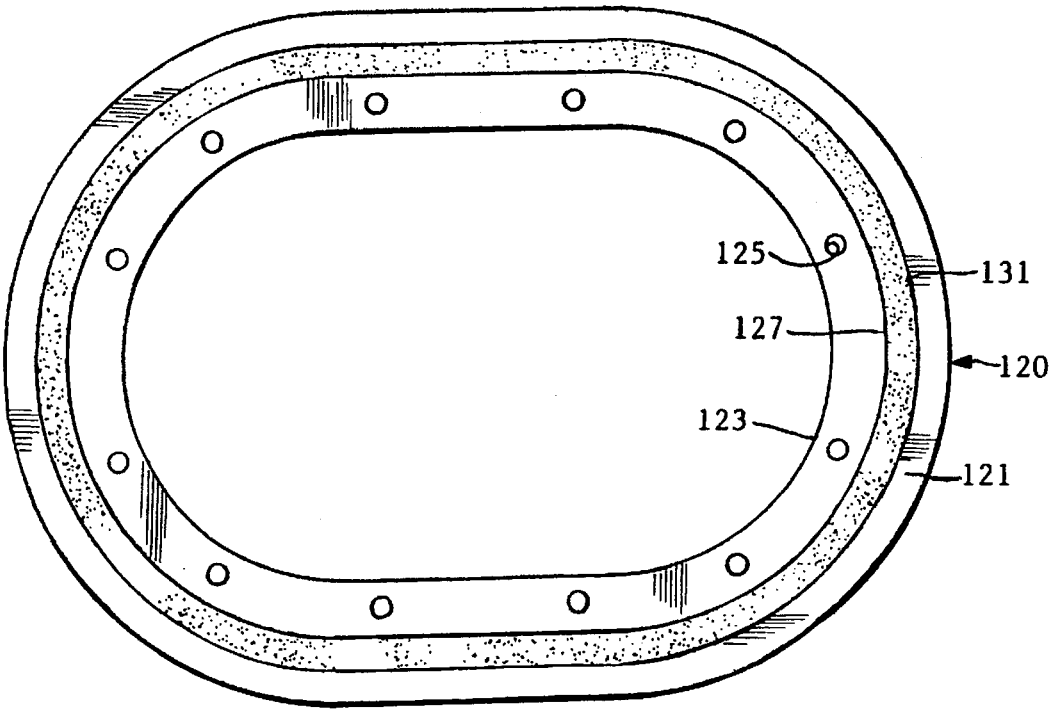
FIG. 14 is a plan view of the base plate of the second embodiment shown in FIGS. 12 and 13, showing the relation to the gasket.
Figure 15:
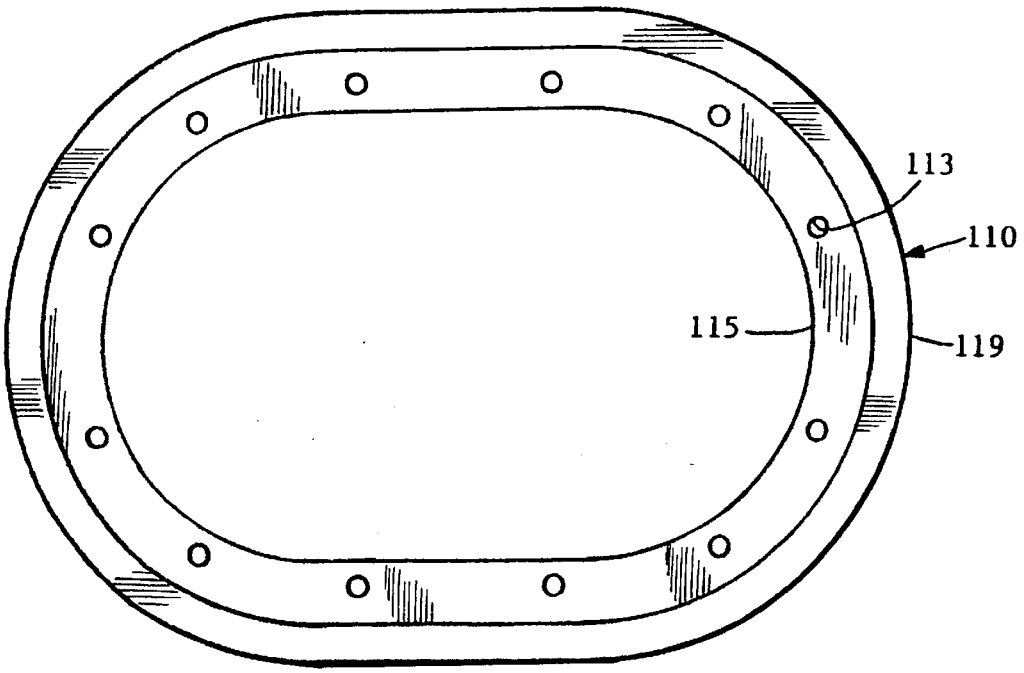
FIG. 15 is a plan view of the clamp plate shown in FIGS. 12 and 13.

FIGS. 14 and 15 are plan views of the base flange plate 120, the gasket 131 and the clamping plate 110.

While the invention has been described with reference to specific embodiments, modifications and variations of the invention may be constructed without departing from the scope of the invention, which is defined in the following claims.

I claim:

1. A through-roof fitting for surrounding and sealing a pipe or stack where it extends through a roof, comprising a base plate having a generally oval laterally extended base flange and a generally oval base body extending upward from the base flange for extending the body through a complementary general oval opening in a roofing sheet, and positioning the base flange under the roof around the opening, first fasteners secured in the base body and accessible generally perpendicular to the flange, a clamp plate having a generally oval clamp flange for cooperating with the base flange and having a generally oval clamp body for overlying the base plate body, openings in the clamp body aligned with the first fasteners in the base plate body for receiving fasteners, a molded boot having a boot base for overlying and surrounding the clamp body, the boot base having openings aligned with the openings in the clamp body for receiving fasteners, an integrally formed generally oval boot sleeve connected to an inward edge of the boot base, the sleeve having a relatively long sloping wall at one end of the oval boot base, and a relatively short sloping wall at the other end of the oval boot base, and having a sloping circular boss connected to a top of the boot sleeve, and a large circular opening in the boss for receiving a pipe or stack, a plurality of second complementary fasteners for connecting to the first fasteners, a sealing gasket provided between the clamp flange and the roofing sheet for compressing against the roofing sheet when the first fasteners and second fasteners are joined and tightened, for sealing and preventing leakage around the roofing sheet opening.

2. The apparatus of claim 1, wherein the gasket is integrally formed with the molded boot.

3. The apparatus of claim 2, wherein the clamp plate is embedded within the boot.

4. The apparatus of claim 1, wherein the clamp plate is integrally molded as a core within the boot.

5. The apparatus of claim 1, wherein the first fasteners comprise nuts captured in the openings of the base plate body, and wherein the second fasteners comprise bolts extending through the openings in the clamp body.

6. The apparatus of claim 5, wherein the clamp body comprises bosses surrounding the openings and extending upward through the boot base, and wherein the bolts comprise heads bearing against the bosses.

7. The apparatus of claim 5, wherein the nuts are pressed into the openings within the base plate body.

8. The apparatus of claim 7, wherein the openings in the base plate body are hexagonal and are tapered from relatively wide openings at the base to relatively narrow openings at a top of the flange plate body, and wherein the nuts are pressed into the openings from the bottom of the flange plate body.

9. A through-fitting for a metal roofing, comprising a base plate with a raised central portion having an inner wall for spacing around a stack or pipe extending through a roof, and having an outer wall for positioning around an opening in roofing, a flange extending outward from a lower edge of the outer wall of the central portion for underlying a metal roofing adjacent the opening formed in the metal roofing, the central portion and the flange having generally elliptical shapes, and the central portion having perpendicular openings for receiving first fasteners, an oval gasket overlying the roofing around the opening in the roofing and around the central portion of the flange plate which projects through the opening, a clamp plate having a generally elliptical shape with a clamp flange extending over the gasket, and a central portion for positioning above the central portion of the base plate, an internal annular step between the flange and central portion of the clamp plate for aligning with an upper part of the outer wall of the central portion of the flange plate for aligning the central portions of the clamp plate and base plate, multiple openings in the central portion of the clamp plate aligned with the openings in the base plate for receiving complementary second fasteners for connection to the first fasteners, a boot connected to the clamp plate and extending upward and inward therefrom, and a large circular opening in the boot for receiving and sealing a stack or pipe and a plurality of first and second complementary fasteners interconnecting the flange plate and clamp plate for clamping the clamp plate on the flange plate and compressing the gasket and sealing the opening in the roof.

10. The apparatus of claim 9, wherein the gasket is integrally formed with the molded boot.

11. The apparatus of claim 10, wherein the clamp plate is embedded within the boot.

12. The apparatus of claim 9, wherein the clamp plate is integrally molded as a core within the boot.

13. The apparatus of claim 9, wherein the first fasteners comprise nuts captured in the openings of the base plate body, and wherein the second fasteners comprise bolts extending through the openings in the clamp body.

14. The apparatus of claim 13, wherein the clamp body comprises bosses surrounding the openings and extending upward through the boot base, and wherein the bolts comprise heads bearing against the bosses.

15. The apparatus of claim 9, wherein the nuts are pressed into the openings within the base plate body.

16. The apparatus of claim 15, wherein the openings in the base plate body are hexagonal and are tapered from relatively wide openings at the base to relatively narrow openings at a top of the flange plate body, and wherein the nuts are pressed into the openings from the bottom of the flange plate body.

17. A method for sealing a through-roof fitting in a metal roofing, comprising an elliptical opening in the metal roofing, placing a base plate under the metal roofing and extending a central portion of the base plate through the roof opening while positioning a flange of the base plate under the roofing around the roofing opening, fixing first fasteners in the central portion of the base plate, placing a gasket around the central portion of the base plate and over the roofing around the opening, placing a clamp plate over the central portion of the base plate and over the gasket by aligning a central portion of the clamp plate with the protruding central portion of the base plate and by aligning a flange on the clamp plate over the gasket, connecting a boot to the gasket and passing a pipe or stack through a central opening in the boot and sealing the central opening around the pipe or stack, inserting second complementary fasteners through openings in the central portion of the clamp plate and connecting the first and second complementary fasteners, tightening the first and second complementary fasteners thereby compressing the gasket against the roofing around the opening and sealing the roofing opening with the gasket.

* * * * *